US005855415A

United States Patent [19]

Lilley, Jr.

[11] Patent Number: 5,855,415

[45] Date of Patent: Jan. 5, 1999

[54] PORTABLE SEAT CUSHION HAVING PRESSURE-REDUCING PROPERTIES

[76] Inventor: Daniel T. Lilley, Jr., P.O. Box 27283, Raleigh, N.C. 27611-7283

[21] Appl. No.: 881,640

[22] Filed: Jun. 24, 1997

[51] Int. Cl.[6] ..... A47C 7/02

[52] U.S. Cl. ..... 297/452.27; 5/655.9; 5/740; 297/DIG. 1; 297/452.37

[58] Field of Search ..... 297/DIG. 1, 452.27, 297/228.13, 183.1; 5/653, 740, 654, 953, 655.9

[56] References Cited

U.S. PATENT DOCUMENTS

| | | | |
|---|---|---|---|
| 3,000,020 | 9/1961 | Lombard et al. | 5/655.9 X |
| 3,833,259 | 9/1974 | Pershing | 297/452.27 |
| 4,086,675 | 5/1978 | Talbert et al. | 5/655.9 |
| 4,840,430 | 6/1989 | Shimada | 297/DIG. 1 X |
| 4,843,662 | 7/1989 | Handelman | 297/DIG. 1 X |
| 5,031,261 | 7/1991 | Fenner, Sr. | 5/740 X |
| 5,294,181 | 3/1994 | Rose et al. | 297/452.25 |

*Primary Examiner*—Peter M. Cuomo
*Assistant Examiner*—Stephen Vu

[57] ABSTRACT

A novel, lightweight portable seat cushion using low-to-medium density cellular elastomer foams with pressure-reducing properties to maximize user comfort and a method for manufacturing one configuration of said cushion.

2 Claims, 4 Drawing Sheets

PORTABLE SEAT CUSHION HAVING PRESSURE-REDUCING PROPERTIES

BACKGROUND—FIELD OF INVENTION

This invention relates to a seat cushion and more specifically to a portable seat cushion having both low carrying weight and improved pressure-reducing properties and also relates to a method for producing a commercial embodiment of the same.

BACKGROUND—DESCRIPTION OF PRIOR ART

Reduction of contact pressure on the buttocks of a seated person is desirable for a number of reasons. These include:

1. reduction or elimination of blood vessel and capillary constriction due to localized seat pressure resulting from non-uniform distribution of body weight;
2. reduction or elimination of acute numbness in the buttocks, legs and feet due to reduction of blood flow due to capillary constriction as a result of sub-optimal distribution of body weight;
3. reduction or elimination of low back pain (particularly sacral region) due to imbalance of pressure on the lower spinal column created by frequent squirming;
4. reduction or elimination of acute pain due to injury or disease of the hips, pelvis and coccyx by redistribution of seat pressure and reduction of local pressure maxima.

Cushioning systems of various types previously have been previously designed to provide pressure reduction by interposing gels, foam materials, air bladders or fibrous materials and combinations thereof between the seated user and the supporting surface which is usually rigid and essentially planar. This discussion will not address all possible combinations, but only those that pertain to prior art examples directly related to the novel invention.

Resilient foams are used widely for seating applications and range in density from nominally 24 kg/m$^3$ to greater than 112 kg/m$^3$. These foams commonly exhibit impact resilience, measured using a standard ball rebound test, of greater than 45% for high resilience foam and predominantly between 30% and 45% for medium resilience foam. The ability of single element of resilient foam to provide pressure reduction is related to its reaction to local forces usually applied at one surface.

Medium-resilience and high-resilience foams exhibit a characteristic whereby the restorative force and local surface pressure increase with increasing local deflection. This characteristic is frequently measured using a load-delivery apparatus with a specified footprint and a force gauge, with results reported as Indentation Force Deflection (IFD). When the force applied exceeds the available deflection due to thickness limitation of the foam, the foam system becomes progressively non-linear. Under conditions of extreme local deflection, the foam cells essentially collapse and the system behaves as a solid, where an increase in applied load produces a one-to-one increase in local pressure. This condition, which may occur frequently in normal use, is commonly called "bottoming" and represents a failure of the system to provide reduction in local seat pressure when compared to that provided by a rigid surface.

To reduce bottoming, foam sections sufficient in thickness or with a sufficiently high IFD and density to permit ample deflection to occur without bottoming can be selected. While this practice usually avoids total failure of the cushion to support the user, it does not represent an optimal solution for reduction of pressure at points of maximum deflection. Sub-optimal pressure reduction is primarily due to the inherent behavior of resilient foam materials, which generate maximum pressure at points of maximum displacement.

A common approach to improve seat cushion performance, represented for example by Vaughn (U.S. Pat. No. 5,288,132; 1994), Siekman and Nachod (U.S. Pat. No. 5,442,823; 1995), Rose and Sleboda (U.S. Pat. No. 5,294,181; 1994), and Snyder and Snyder (U.S. Pat. No. 4,522,447; 1985) is to implement a composite cushion system whereby areas of greater local displacement, such as the ischial prominences of the lower hip, are supported by foams having a relatively low IFD characteristic or by a cavity or by a recess. These approaches require foams having either higher IFD values or higher density be used in areas of lower deflection, or that an increase in foam thickness be used, to prevent or lessen any tendency to exceed available deflection and prevent consequent bottoming. In frequent practice, foams of higher density (greater than 64 kg/m$^3$) and of increased thickness are selected in order to maintain a sufficient degree of comfort and support.

A potential drawback of the approaches discussed above is that they are not optimally suited for the range of user body types and weights likely to be encountered. Additional drawbacks include increased weight which inhibits or restricts portability, and increased seat cushion thickness which further reduces portability and convenience and may introduce instability for the seated user.

Another potential solution, exemplified by Yoshiyuki, et al. (U.S. Pat. No. 5,105,491; 1992) utilizes a layer of foam exhibiting a low impact resilience characteristic (high damping factor). It should be noted that Yoshiyuki, et al. refers to mold-in-place foam elements only for automotive applications, whereas the novel invention described herein utilizes a plurality of cast foams that have been cut into sheets and fabricated into layered composites using adhesive lamination technology, for portable or static seating applications.

Unlike a high-resilience or medium-resilience foam, a low-resilience foam expresses a decline in measured stiffness, or IFD value, as a function of an increase in its temperature. Chemical formulations can be optimized to provide localized reduction in stiffness at body surface temperatures of 30 C.–35 C., with consequential reductions in local pressure and increased comfort.

Low-resilience foams also exhibit impact absorbing and energy dissipation characteristics, which are desirable in shock-prone transportation applications but are of limited value in stationary or portable seating environments. A common engineering obstacle in designing with low-resilience foams is their generally poor physical strength at low-to-moderate densities (less than 80 kg/m$^3$.) The requirement of high density (greater than 80 kg/m$^3$) to achieve durability substantially limits the singular use of low-resilience foams for weight-sensitive applications such as portable seating.

OBJECTS AND ADVANTAGES

Conventional approaches using only high-resilience foams or only low-resilience foams are limited in performance and practical feasibility. It has been demonstrated by the author, however, that specific combinations of foam layers having either medium-resilience or low-resilience and low-to-medium density can be combined using various methods to provide improvements in comfort, reduction of total seat cushion weight and reduction of total seat cushion height. The general solution relies on selection and lamination of foams of differing IFD values to produce a composite seat cushion that employs relatively high IFD foam materials located at the base support with progressively lower IFD foam materials disposed nearer to the seated occupant. Incorporation of low-resilience foam materials in the intermediate and upper layers of the composite provides the additional benefit of temperature-sensitive softening and consequent reductions in seat pressure, while maintaining stable support to the hips and lower back.

Several objects and advantages of the present invention are a) to provide improvement in user comfort through design elements utilizing various types of foam elastomers that soften in response to the user's body temperature;

b) to provide improvement in user comfort by selection and configuration of foam elastomers which redistribute body weight evenly to reduce seat pressure and reduce or eliminate numbness in the buttocks, legs and feet;

c) to provide a lightweight portable seat cushion which has high utility for indoor and outdoor seating including but not limited to stadium seats, metal seats, benches, bleachers, folding chairs, church pews, office chairs, boat seats and automobiles; and d) to provide reduction of total cushion height which improves portability, reduces the overall height to which seated user is raised above a standard chair height, and reduces storage space requirements.

DRAWING FIGURES

REFERENCE NUMERALS IN DRAWINGS

Figure 1:
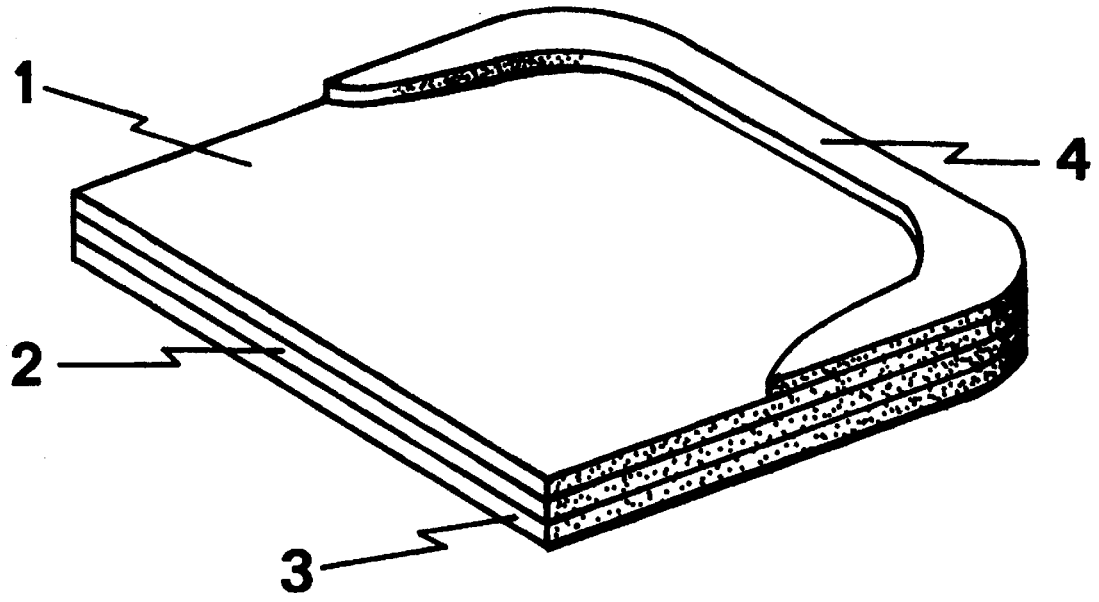
FIG. 1 represents a perspective view showing one embodiment of a portable seat cushion in accordance with the present invention.

1 upper foam layer
2 intermediate foam layer
3 lower foam layer
4 hip cradle layer
5 fabric cover
6 carrying handle
7 zipper
8 anchor strap assembly
9 front segment of anchor strap assembly
10 loop fastener strip
11 rear segment of anchor strap assembly
12 hook fastener strip

SUMMARY

It is therefore an objective of the present invention to provide a portable seat cushion which exerts superior load distributing properties by selective implementation of both low-resilience and medium-resilience foams and provides comfortable seating over a broad range of applications while exhibiting low carrying weight.

GENERAL DESCRIPTION

In order to accomplish the above objective, the body of a seat cushion is comprised of a plurality of laminated layers of low-to-medium density cellular elastomers having varying ranges of compression resistance, or IFD, and varying ranges of impact resilience. The present invention develops such a novel construction that one or more upper foam layers which are predominantly in contact with a seated occupant are to exhibit a low-resilience characteristic, having an impact resilience of less than 15%, a measured IFD of between about 10 and about 35 when measured at 21 degrees Celsius by standard method ASTM 3574 at 25% compression, and density of between about 24 kg/m$^3$ and about 96 kg/m$^3$. The seat cushion in accordance with the present invention also comprises at least one lower layer and commonly a plurality of lower or intermediate layers of medium-resilience foam having an impact resilience not less than 30%, IFD value of between about 30 and about 160 when measured at 21 degrees Celsius by standard method ASTM 3574, and density of between about 24 kg/m$^3$ and about 96 kg/m$^3$.

In general configuration, a seat cushion in accordance with the present invention comprises one or more upper layers of foam having impact resilience of not greater than 15% and exhibiting temperature-sensitive compression stiffness response in the temperature range between 10 degrees Celsius and 40 degrees Celsius, and one or more layers of foam for supporting the upper layers, said support layers having medium impact resilience of not less than 30%. In alternative configurations, low-resilience and high-resilience foams may be interposed or sandwiched in alternating layers to achieve a specific compression-temperature response. Additionally, partial layer elements and layer segments may be interposed, superposed or supraposed to provide a specific dimensional contour for the enhancement of seating comfort or seating support. Said layer elements and layer segments may be comprised of either medium-resilience or low-resilience foams as may be necessary to elicit specific cushioning and support characteristics.

A method for producing the seat cushion comprises adhesively laminating sections of foams of various thickness and of various types as described above into a substantially planar sheet. Each layer of foam is adhesively bonded to adjacent layers using a flexible adhesive sufficient in ultimate bond strength to produce a foam-tearing bond when subjected to destructive peel delamination test methods. Other methods of adhesion such as open-flame bonding may also be suitable for adhering foam layers. For producing a minimal two-layer configuration of the novel seat cushion, comprising an upper layer of low-resilience foam having an impact resilience of not greater than 15% and a lower layer of medium-resilience foam having an impact resilience of not less than 30%, a cast sheet of one foam layer of predetermined thickness is coated with a layer of flexible adhesive and then mechanically bonded to the remaining foam layer of the same or different predetermined thickness using mechanical pressure applied by a lamination press or by a manual or automatic compression roller system.

The thickness of each adhesive layer may vary based on the type of adhesive used and by the surface morphology and chemical constituents of the selected foams. Application of the adhesive layers can be accomplished by any suitable means including spray coating, roll coating, or trowel or by use of any suitable pressure-sensitive adhesive package, supported or unsupported, incorporating a release liner, all of which means are standard and customary within the commercial foam fabrication industry. Application of superposed or supraposed die-cut foam segments may be accomplished by use of spray-type or pressure sensitive adhesives applied manually or by any suitable automated means.

Fabrication of a predetermined shape of portable seat cushion having various dimensions is accomplished by use of steel rule die and die-cut press, or high-pressure water jet apparatus, or abrasive wire foam cutting apparatus or foam-cutting knife saw. It is often preferable to use the steel rule die and die-cut press method, primarily for reasons of economics and due to the general predominance of die-cutting equipment and procedures within the commercial foam fabrication industry.

DETAILED DESCRIPTION—FIGS. 1 to 4

The seat cushion provided in accordance with the present invention is represented by a preferred embodiment consisting of four layers of foam arranged in a laminated construction and die-cut into a predetermined shape as illustrated in FIG. 1, including a substantially crescent-shaped top layer which both provides cradle support to the hips and serves as a positioning indicator for the seated user.

In the drawings, reference numeral 1 indicates a layer of low-resilience foam having an impact resilience of not greater than 15%, IFD between about 10 and about 25, and density between about 24 kg/m$^3$ and about 40 kg/m$^3$. Reference numeral 2 indicates a layer of medium-resilience foam having an impact resilience of not less than 30%, IFD between about 35 and about 90, and density between about 27 kg/m$^3$ and about 45 kg/m$^3$. Reference numeral 3 indicates a layer of medium-resilience foam having an impact resilience of not less than 30%, IFD not less than about 110, and density of between about 40 kg/m$^3$ and about 60 kg/m$^3$. Reference numeral 4 indicates a layer of substantially crescent-shaped, medium-resilience foam having an impact resilience of not less than 30%, IFD between about 25 and about 45, and density between about 28 kg/m$^3$ and about 50 kg/m$^3$.

Reference numeral 5 indicates a cover which is removable from the cushion and constructed of textile fabric. Said cover, in the preferred embodiment, exhibits resistance to absorption or passage of fluids and thus provides weather-resistant and stain-resistant properties. Said fabric may be of any suitable fiber base including natural fibers, natural fiber/man-made fiber blends, or man-made fiber such as Nylons®. In the preferred configuration, said cover is constructed of 100% polyester woven fabric with waterproof back-coating or polymer-coated 2-way stretch polyester fabric. The cover is constructed using traditional methods incorporating die-cut or scissor-cut fabric panels assembled using standard, commercial sewing apparatus and methods.

Figure 2:
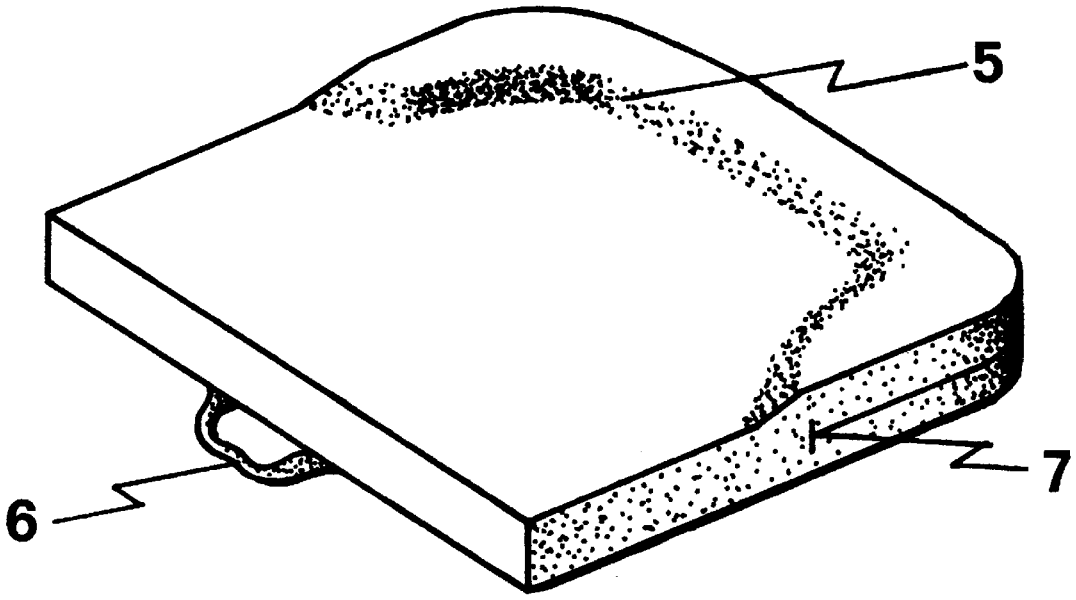
FIG. 2 represents a perspective view showing said portable seat cushion fitted with a fabric cover, a strap-type carrying handle and a zipper closure.
Figure 3:
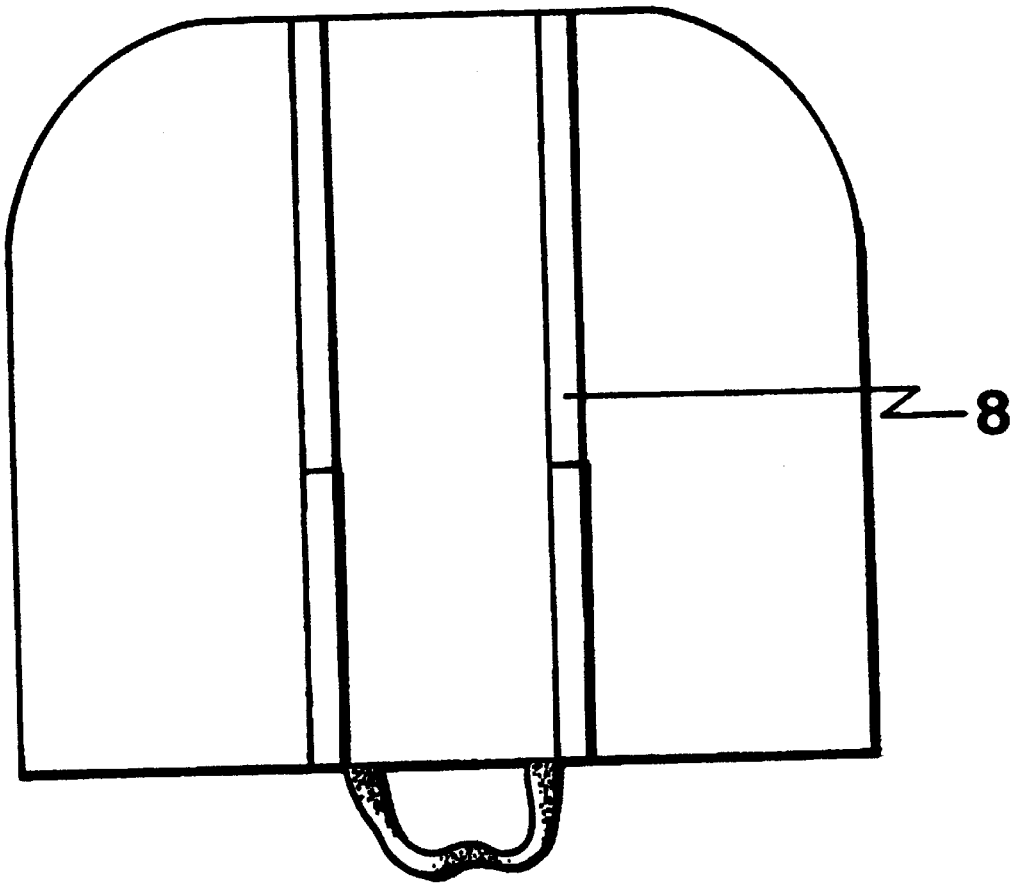
FIG. 3 represents an elevation view showing the bottom of said portable seat cushion and showing locations of two anchor straps secured against the seat cushion.
Figure 4:
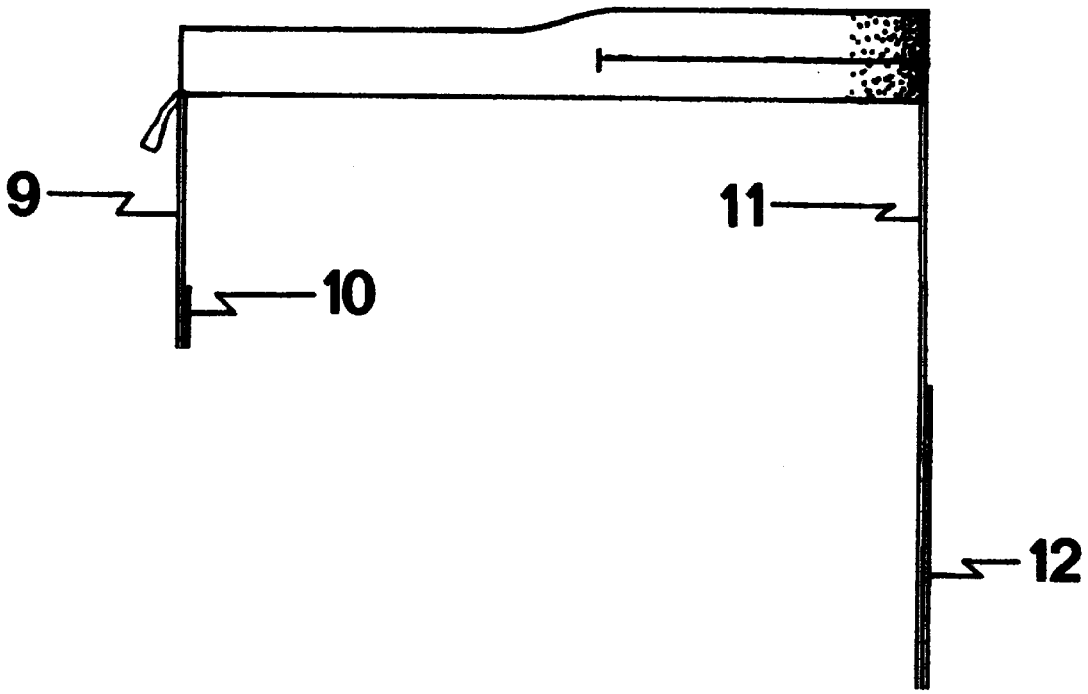
FIG. 4 represents an elevation showing a side view of said portable seat cushion and showing detail of said anchor straps in released position with locations of Velcro-type hook and loop fastener strips.

Reference numeral 6 indicates a carrying handle constructed of fabric webbing. Said carrying handle is sewn into the lower forward seam of the cover during cover assembly, and is disposed as indicated in FIG. 2 Reference numeral 7 indicates a zipper which is installed into the cover during assembly. Said zipper typically is constructed of Nylon or similar plastic material, however a steel zipper element may also be used. The location of the separation line of the zipper is about equidistant from the top rear and bottom rear fabric panel seams of the cover. The zipper extends horizontally across the back elevation of the seat cushion cover and partially around both sides of the cover. For proper function, said zipper must be of sufficient length, width and physical strength, and be uniformly disposed to permit repeated insertion and removal of a cushion without damage to either the cushion or the zipper.

Reference numeral 8 refers to an anchor strap consisting of two overlapping lengths of Nylon or similar type fabric webbing. In the preferred portable seat cushion embodiment, there are two anchor straps supplied, wherein the forward end of each said anchor strap is disposed adjacent to and exterior to the carrying handle. The rear attachment point for said anchor strap is located at the lower rear seam of the cover. The anchor strap lengths are aligned at a substantially 90 angle to the front edge of the cushion, and are positioned predominately parallel to each other.

Reference numeral 9 indicates a front anchor strap segment of two anchor strap assembly. Reference numeral 10 indicates a Velcro or similar type loop fastener strip which is mechanically, attached to said front anchor strap segment using standard sewing assembly methods. Reference numeral 11 indicates a rear anchor strap segment of said anchor strap assembly. Said rear strap segment is about equivalent in length to the front-to-rear dimension of the assembled cover at the mid-point of the cover's width. Reference numeral 12 indicates a Velcro or similar type hook fastener strip which is mechanically attached to said rear anchor strap segment using standard sewing assembly methods.

The purpose of the anchor straps is to secure the portable seat cushion when it is used with stadium seats, folding chairs, bleachers, benches and office chairs and other suitable types of seats. In actual use, the front and rear anchor strap segments are to be directed under the seat or bleacher deck and joined at their meeting point under the seat using the hook-and-loop strips to affix one strap segment to the other, and when so joined resist unintentional separation of said segments.

Although the invention is described with respect to a preferred embodiment, modifications thereto will be apparent to those skilled in the art. Therefore, the scope of the invention is to be determined by reference to claims which follow.

I claim:

1. A portable seat cushion having a mechanically laminated foam composite comprising of a) at least one upper foam layer of IFD between about 15 and 25, having low impact resilience of not more than 15;

b) at least one intermediate foam layer having low impact resilience between 5% and 15% and having IFD between 30 and 50;

c) at least one lower foam layer having medium impact resilience not less than 30% and IFD not less than 110;

d) at least one superposed layer segment of low-to-medium resilience foam having impact resilience between 5% and 50% and IFD between 25 and 55; and e) said foam layers ranging in density from 24 kg/m$^3$ to 96 kg/m$^3$; and f) wherein said foam layers are mechanically laminated to produce a multi-layer composite.

2. A portable seat cushion according to claim 1, wherein said polymer foam layers are mechanically laminated to produce a four-layer composite, comprising a) an upper foam layer consisting of a low resilience foam having impact resilience not greater than 15% and IFD between 10 and 25;

b) a lower foam layer having an impact resilience of not less than 30% and IFD not less than 110 to support upper foam layers;

c) an intermediate foam layer disposed between said upper and lower foam layers and having impact resilience not less than 30% and IFD between 35 and 90;

d) a predominantly crescent-shaped foam layer, adhesively attached and disposed at a top rear section of the cushion composite and extending along both sides of the cushion, said foam layer having an impact resilience of not less than 30% and IFD between 25 and 55, to provide moderate lifting of the hips of the seated user, in addition to providing lateral stability to reduce obliquity of the hips while seated;

e) all said foam layers ranging in density between 24 $kg/m^3$ and 96 $kg/m^3$; and f) said portable seat cushion composite being encased in a removable, assembled fabric cover having two web fabric anchor straps wherein said anchor straps are disposed on the bottom of the cover and aligned in a front-to-back arrangement, and said anchor straps being supplied with hook-and-loop fastener to provide interlocking force to prevent separation of anchor strap segments.

* * * * *